US007980903B2

(12) United States Patent
Bitz et al.

(10) Patent No.: US 7,980,903 B2
(45) Date of Patent: Jul. 19, 2011

(54) INSTALLATION SWITCH DEVICE HAVING A CONNECTING TERMINAL ARRANGEMENT

(75) Inventors: Matthias Bitz, St. Leon-Rot (DE); Ralf Kraus, Neckargemuend (DE); Klaus-Peter Eppe, Waldbrunn (DE)

(73) Assignee: ABB AG, Ladenburg (DE)

( * ) Notice: Subject to any disclaimer, the term of this patent is extended or adjusted under 35 U.S.C. 154(b) by 0 days.

(21) Appl. No.: 12/722,123

(22) Filed: Mar. 11, 2010

(65) Prior Publication Data

US 2010/0227513 A1 Sep. 9, 2010

Related U.S. Application Data

(63) Continuation of application No. 12/194,735, filed on Aug. 20, 2008, now Pat. No. 7,704,105.

(30) Foreign Application Priority Data

Aug. 22, 2007 (DE) ..... 10 2007 039 709

(51) Int. Cl.
*H01R 4/36* (2006.01)

(52) U.S. Cl. ..... 439/813

(58) Field of Classification Search ..... 439/810–813, 439/709, 718

See application file for complete search history.

(56) References Cited

U.S. PATENT DOCUMENTS

| | | | | |
|---|---|---|---|---|
| 3,414,866 | A * | 12/1968 | Norden | 439/586 |
| 4,832,628 | A | 5/1989 | Huska | |
| 5,249,989 | A | 10/1993 | Alsch | |
| 5,580,286 | A | 12/1996 | Kramer et al. | |
| 5,653,614 | A | 8/1997 | Eschermann et al. | |
| 6,255,608 | B1 | 7/2001 | Kawata et al. | |
| 6,293,830 | B1 * | 9/2001 | Park et al. | 439/801 |
| 6,769,938 | B2 | 8/2004 | Eckert et al. | |
| 7,234,981 | B2 | 6/2007 | Eppe et al. | |
| 7,625,253 | B2 | 12/2009 | Eppe et al. | |
| 7,704,105 | B2 * | 4/2010 | Bitz et al. | 439/810 |
| 2005/0230231 | A1 | 10/2005 | Kadan et al. | |
| 2008/0096441 | A1 | 4/2008 | Eppe et al. | |
| 2008/0099317 | A1 | 5/2008 | Weber et al. | |
| 2008/0102714 | A1 | 5/2008 | Weber et al. | |

FOREIGN PATENT DOCUMENTS

| | | | |
|---|---|---|---|
| DE | 144626 | A1 | 10/1980 |
| DE | 4134004 | A1 | 4/1992 |
| DE | 9412245 | | 11/1994 |
| DE | 69513571 | | 3/2000 |
| DE | 10006667 | A1 | 8/2000 |
| DE | 69516034 | | 1/2001 |

(Continued)

*Primary Examiner* — Vanessa Girardi
(74) *Attorney, Agent, or Firm* — Leydig, Voit & Mayer, Ltd.

(57) ABSTRACT

An installation switch has an insulating housing and a terminal connecting arrangement for clamping a connecting conductor having an annular terminal shoe. The terminal connecting arrangement includes a terminal socket having an interior disposed between an insertion opening for receiving the terminal shoe and an access opening and a terminal screw having a screw head and a screw shank disposed in the interior of the terminal socket, the screw being actuatable in a longitudinal direction within the interior of the terminal socket between an open state and a clamped state. The arrangement further includes a connection plate having a screw hole with interior threads for threadably engaging the terminal screw when in the clamped state and a retaining device preventing the terminal screw from being removed from the terminal socket when in the open state.

14 Claims, 4 Drawing Sheets

FOREIGN PATENT DOCUMENTS

| | | | |
|---|---|---|---|
| DE | 10304248 | A1 | 1/2004 |
| DE | 202004002779 | | 6/2005 |
| DE | 202006001211 | | 5/2007 |
| EP | 0681342 | A1 | 11/1995 |
| EP | 0688063 | A1 | 12/1995 |
| EP | 1291978 | A2 | 3/2003 |
| FR | 2 667 989 | A1 | 4/1994 |

* cited by examiner

INSTALLATION SWITCH DEVICE HAVING A CONNECTING TERMINAL ARRANGEMENT

CROSS REFERENCE TO PRIOR APPLICATIONS

This is a continuation of U.S. application Ser. No. 12/194,735, filed Aug. 20, 2008 and issued on Apr. 27, 2010 as U.S. Pat. No. 7,704,105, which claims priority to German Patent Application No, DE 10 2007 039 709.9 filed Aug. 22, 2007. The entire disclosure of both applications is incorporated by reference herein.

The invention relates to an installation switch device having an insulating material housing and a connection terminal arrangement for clamping a connection conductor having an annular terminal shoe.

BACKGROUND

In conventional installation switch devices, the connecting conductor is screwed to a connection plate, which includes a screw hole and is mounted so as to be stationary in the interior of the device, by means of a terminal screw including a screw head and a screw shank. The connecting terminal arrangement is located in a terminal socket including an opening for inserting the connecting conductor and an opening providing access to the screw head for actuating the terminal screw with a tool, for example a screwdriver. When the connecting conductor is clamped, the screw shank penetrates the annular terminal shoe and is in threaded engagement with the screw hole.

Conventional installation switch devices are, for example, circuit breakers, motor circuit breakers or fault-current circuit breakers, the connecting terminal arrangement of which is formed specifically to connect a connecting conductor to an annular terminal shoe, in particular a terminal shoe with a closed ring. A hole through which the terminal screw is guided upon clamping is thus provided in the annular terminal shoe. Terminal screws which include a flat head and a long shank and which are screwed into a connection plate in the interior of the switch device housing are used in the known conventional installation switch devices. In this way, the terminal shoe is clamped between the screw head and the connection plate, optionally with an additional thrust piece inserted therebetween. Attached to the connection plate are further conductors which lead into the interior of the device and carry the current path through the installation switch device between an input terminal and an output terminal.

A connecting conductor having an annular terminal shoe cannot be clamped between the screw head and the connection plate unless the terminal screw has been completely unscrewed and lifted off the connection plate beforehand in such a way that a passage is formed at the insertion opening for the closed terminal shoe. During this process, the terminal screw may fall out and be lost through the access opening. Inserting the terminal screw after the connecting conductor including the annular clamping shoe has been introduced requires skill from the engineer, since, due to the long shank and the flat head of the conventionally-used terminal screws, it is easy for said screws to tilt in the terminal socket between the access opening and the thread in the connection plate in such a way that the screw shank does not come into threaded engagement with the screw thread of the connection plate.

An object of the present invention is therefore to develop a conventional installation switch device in such a way that the terminal screw cannot be lost when connecting a connecting conductor with an annular terminal shoe and it is easier to screw in the terminal screw.

SUMMARY

The present invention is directed to a screw head coupled to the insulating material housing in the interior of the terminal socket so as to be displaceable in the longitudinal direction of movement of the terminal screw in such a way that when the terminal screw is moved between an open position of the screw, in which there is a gap for inserting the terminal shoe of the connecting conductor between the free end of the screw shank and the connection plate, and a set-down position of the screw, in which the screw shank is just beginning to be engaged in the thread of the screw hole, the axis of movement of the screw shank remains aligned with the axis of the screw hole. The terminal socket further includes a device for retaining the terminal screw, so removal of the terminal screw from the terminal socket is prevented in the open position of the screw. The retaining device provided according to the invention prevents the terminal screw from being lost. The process of screwing in the terminal screw is simplified by the movable coupling to be provided according to the invention between the screw head and the insulating material housing in the interior of the terminal socket, since this prevents the screw shank from tilting.

According to an embodiment of the present invention, the screw head includes, for the movable connection thereof, first guide means which are provided on the screw head and extend in the direction of the longitudinal movement of the screw, and the insulating material housing includes, in the region of the terminal socket, second guide means provided in the terminal socket, which guide means cooperate to guide the movement of the terminal screw in the longitudinal direction when the screw is inserted in the terminal socket. The first guide means provided on the screw head may thus be a component of the screw head.

An embodiment of the present invention includes a configuration where the screw head is a cylinder which extends longitudinally in the longitudinal direction of movement of the screw, the first guide means being formed by the casing of this cylinder. Another embodiment includes a configuration where the terminal socket includes a wall which extends in the longitudinal direction of movement of the terminal screw and encompasses the screw head in a guiding manner. A terminal screw including a screw head which is formed as a longitudinally-extended cylinder is encompassed by the wall along its cylinder casing and is thus guided. Tilting of the terminal screw is thus prevented by the fact that the casing surface of the cylindrical screw head displaceably abuts the guiding wall.

An embodiment in which the guiding wall is formed by the inner wall of a cylindrical guide channel, which is located in the terminal socket which encompasses the screw head, is particularly advantageous.

The retaining device is advantageously an undercut which extends into the terminal socket in the region of the access opening. An undercut of this type can be simply produced together with the housing shells when forming the housing by injection moulding. The terminal screw is then to be introduced into the terminal socket before the housing is closed.

Another embodiment of the present invention includes a configuration where the screw head and the wall are engaged by means of a thread in the open position of the terminal screw in such a way that, when the terminal screw is in the open position, it may thus be held displaceably. In this way, the terminal screw may be positioned in a defined manner when it is in the open position. The threaded engagement according to the invention between the terminal screw and the wall also prevents loss of the screw.

The threaded engagement between the screw head and the wall begins where the threaded engagement between the screw shank and the screw hole ends. When the terminal screw is screwed by actuation with a tool, out of its clamping position, in which it is screwed in the connection thread to the connection plate, the screw head of said terminal screw moves upwards in the direction of the longitudinal displacement thereof towards the access opening. The threaded engagement between the shank of the terminal screw and the screw thread of the connection plate comes to an end when the set-down position has been reached. In a configuration according to the invention in which the screw head includes an external thread, in conjunction with an arrangement according to the invention in which an internal thread corresponding therewith is provided in the wall, the threaded engagement of the screw head and wall begins in the set-down position in such a way that when the screwdriver actuates the terminal screw further, the terminal screw is screwed out into the wall, as it were, via the internal thread. It is therefore no longer possible to lose the screw and it is held in the open position by the thread without the engineer having to hold it from outside, and this facilitates insertion of the annular terminal shoe.

When screwing the terminal screw out of the open position, the screw shank is securely guided by the thread in the wall towards the screw thread in the connection plate. The threaded engagement between the screw head and the wall ends, and the threaded engagement between the screw shank and the screw thread in the connection plate begins when the screw reaches the set-down position. The terminal screw is then screwed into the screw thread in the connection plate by continuous actuation of the tool until the clamping position is reached once again.

The screw head is particularly advantageously provided with an external thread and the wall with an internal thread.

With regard to the connection plate, an embodiment of the present invention provides that the connection plate is a leg of a U-shaped busbar, which is mounted so as to be stationary in the housing of the installation switch device and of which the second leg, which is opposite the connection plate, is connected therewith via a web.

A conductor rail may advantageously be integrally formed on the free end of the connection plate to connect further conductors in the interior of the installation switch device.

In yet another embodiment according to the present invention, the web may be contacted from outside the housing for testing and calibration purposes. Establishing contact for testing purposes is required, for example, when hot testing the thermal trip of a circuit breaker. In this process, a defined level of excess current, which may be approximately 1.5 times the rated current, is connected to the device via the web by means of a testing terminal using appropriate test equipment, and whether or not the thermal trip in the interior is triggered in the required disconnection time is tested.

BRIEF DESCRIPTION OF THE DRAWINGS

The invention, as well as further advantageous configurations and improvements of the invention, will be explained in greater detail and described with reference to the drawings in which two embodiments of the invention are shown.

In the drawings.

DETAILED DESCRIPTION

Figure 1:
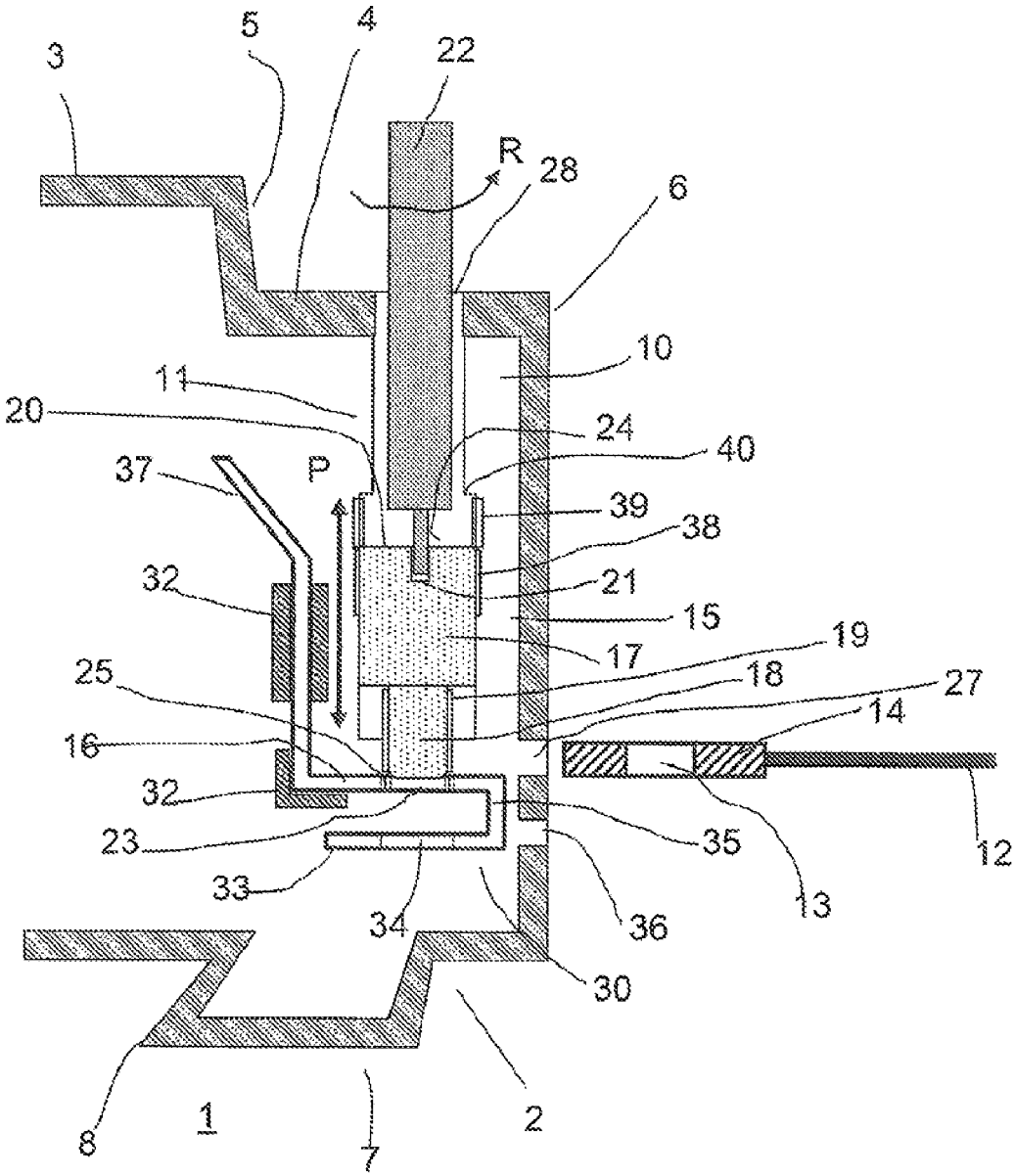
FIG. 1 shows a first embodiment of the present invention, in which the terminal screw is in the set-down position.

FIG. 1 is a schematic partial cross-sectional view of an installation switch device 1 which includes an insulating material housing 2. The installation switch device 1 is, for example, a circuit breaker. The insulating material housing thereof includes a leading and trailing front face 3, 4, a leading and trailing side face 5, 6 and a fastening face 7. Provided on the fastening face 7 is a fixed tab 8 which cooperates with a further, generally displaceable tab (not shown) when clamping the circuit breaker 1 to a support rail.

In the region of the trailing side face 6, a terminal socket 10, in which a connecting terminal arrangement 11 is accommodated, is provided in the housing 2. The terminal socket 10 can be accessed from the trailing side face 6 through an insertion opening 27 for a connecting conductor 12 and can be accessed from the trailing front face 4 through an access opening 28 for an actuation tool, for example a screwdriver 22.

Together with the connecting terminal arrangement 11, the connecting conductor 12, which includes an annular terminal shoe 14 having a central opening 13, is screwed to a connection plate 16 by a terminal screw 15.

The terminal screw 15 includes a screw head 17, which is formed as a longitudinally-extended cylinder, and a shank 18. The shank 18 is approximately as long as the screw head 17. The shank 18 has an external thread 19. Provided on the free end face 20 of the screw head 17 is a slot 21 for receiving the actuation tool, such as a screwdriver 22.

The connection plate 16 includes a screw hole 23 with an internal thread 25. The connection plate is aligned so as to be approximately parallel with the trailing front face 4. The connection plate 16 forms one leg of a U-shaped busbar 30 which is mounted so as to be stationary in the housing 2 of the installation switch device 1 by web-like housing projections 32.

The second leg 33 of the U-shaped busbar 30 is connected to the connection plate 16 via a web 35. The second leg 33 includes an opening 34 which faces the screw hole 23 and has a diameter of at least the same size as that of said screw hole.

The busbar 30 is arranged in the housing in such a way that the web 35 is located in the vicinity of the trailing side face 6 and may be accessed from outside via a testing opening 36 for establishing contact by means of a test prod for testing or calibration purposes.

Integrally formed on the free end of the connection plate 16 is a conductor rail 37, to which further conductors leading into the interior of the installation switch device 1 may be connected. However these conductors are not shown in the diagram, and neither are all of the further components and modules required to operate an installation switch device, such as a thermal and electromagnetic trip, a switch mechanism, a switch lever with a contact point, an electric arc quenching arrangement, etc.

The terminal screw 15 is guided in the terminal socket 10 in an approximately cylindrical guide channel 24. The guide channel 24 extends approximately parallel to the trailing side face 6 in such a way that the terminal screw 15 is guided vertically through said channel to the screw hole 23 in the connection plate 16. The inner diameter of the guide channel 24 thus corresponds to the outer diameter of the screw head 17 in such a way that the screw head 17 is guided in a sliding manner in the guide channel 24 and is coupled to the insulating material housing so as to be able to move to some extent in the interior of the terminal socket 10.

Figure 2:
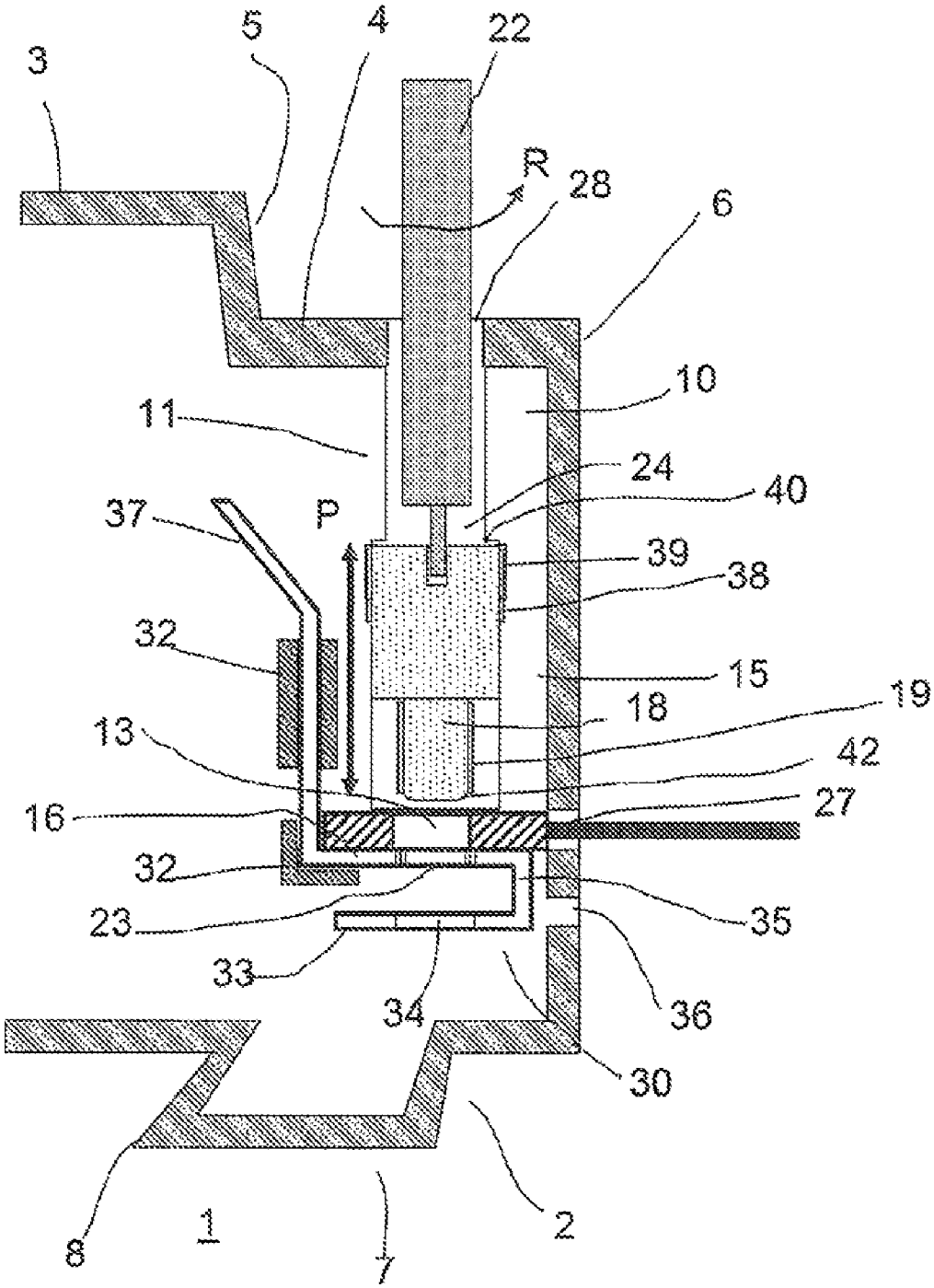
FIG. 2 shows the embodiment from FIG. 1, the terminal screw being in the open position.

In FIG. 1, the terminal screw 15 is shown in its set-down position, that is to say, the free end of the screw shank 18 is positioned directly on the internal thread 25 of the screw hole 23. The annular terminal shoe 14 cannot be inserted into the terminal socket 10 in this position, since the terminal shoe is blocked by the screw shank 18. Before the terminal shoe is inserted, the terminal screw 15 must be raised from the connection plate 16 in the direction of the arrow P to such an extent that a gap corresponding to at least the depth of the terminal shoe 14 is formed between the free end of the shank 18 and the connection plate 16 so the terminal shoe 14 can then be pushed through the insertion opening 27 until it strikes the conductor rail 37 and the opening 13 of the terminal shoe rests directly above the screw hole 23. This position is shown in FIG. 2.

The conductor rail 37 thus has a second function as an insertion stop for the terminal shoe 14 and prevents the terminal shoe from being inserted too far, and this further facilitates the installation of the connecting conductor 12.

The upper portion of the screw head 17 has an external thread 38. An internal thread 39 is provided on the inner wall of the guide channel 24. This internal thread begins where the outer thread 38 on the screw head 17 ends in the set-down position according to FIG. 1. If the terminal screw 15, in the set-down position shown in FIG. 1, is then rotated further in the direction of the arrow R by means of the screw driver 22, the screw head 17 and the inner wall of the guide channel 24 become engaged by means of the thread and, when the terminal screw 15 is rotated further, said screw is moved upwards via the internal thread 39 into the open position and is held in said position when the rotational movement is discontinued.

After the connecting conductor 12 including the terminal shoe 14 has been inserted (see FIG. 2) the terminal screw 15 may be moved downwards again by being rotated in the internal thread 39. In this process, the terminal screw passes through the opening 13 of the terminal shoe 14 and thus retains it.

Figure 3:
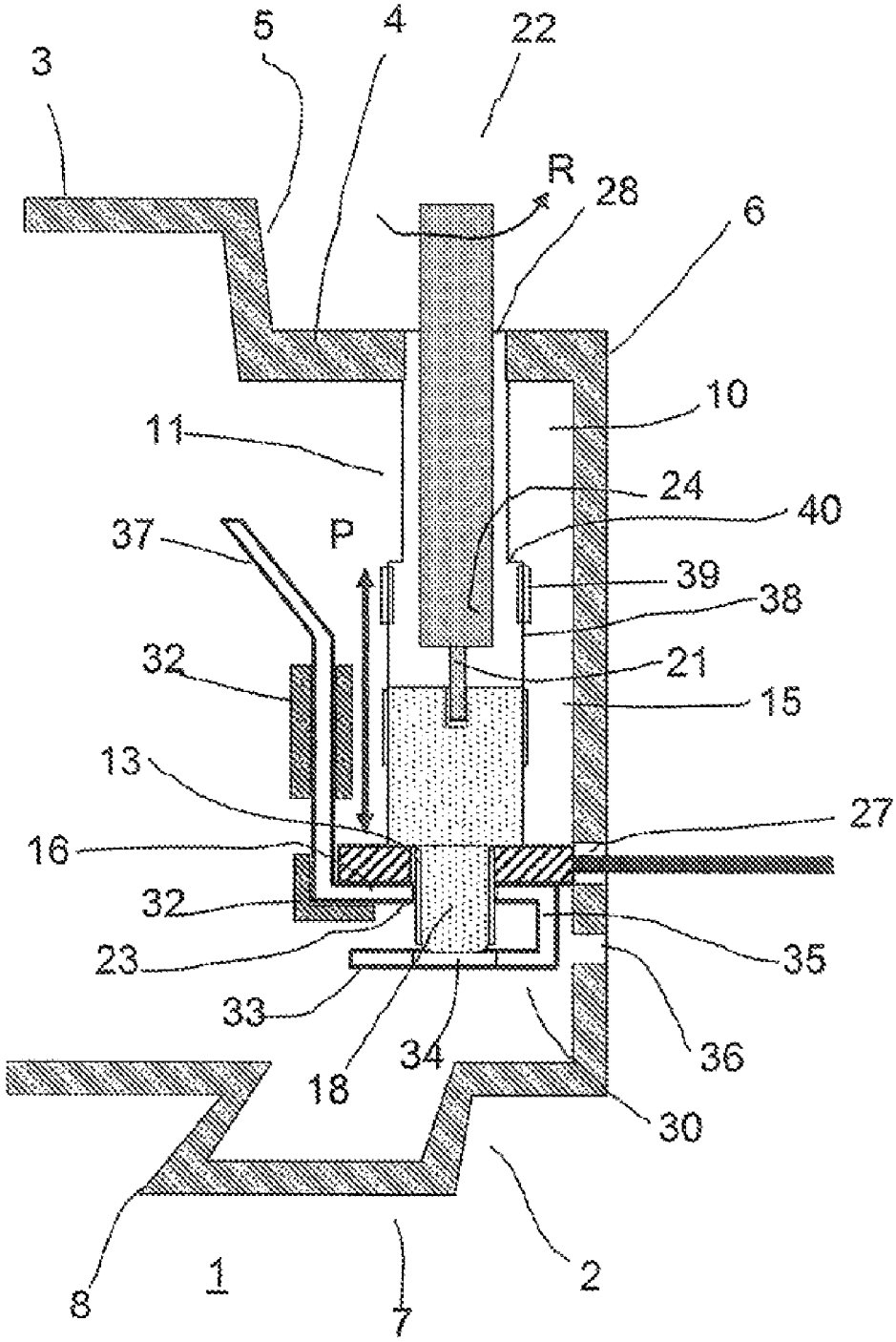
FIG. 3 shows the embodiment from FIG. 1, the terminal screw being in the clamped position.

When the set-down position has been reached, the threaded engagement of the external thread 38 of the screw head 17 and the internal thread 39 of the inner wall of the guide channel 24 ends and, when the terminal screw 15 is rotated further with a slight degree of downward pressure, the threaded engagement between the external thread 19 of the shank 18 and the internal thread 25 of the screw hole 23 begins. When the terminal screw 15 is rotated further, said screw is pulled downwards further into the screw hole 23 as a result of the threaded engagement until the terminal shoe 14 is clamped firmly between the screw head 17 and the connection plate 16. This position is shown in FIG. 3. In this way, a secure screw connection with a good degree of surface contact can be produced.

If the shank 18 were somewhat longer, it could be accommodated in the opening 34 in the second leg 33. In a variant (not shown), the opening 33 could also be provided with an internal thread and thus optionally also be engaged with the shank 18 by means of the thread and therefore contribute to the clamping action of the screw connection.

Figure 4:
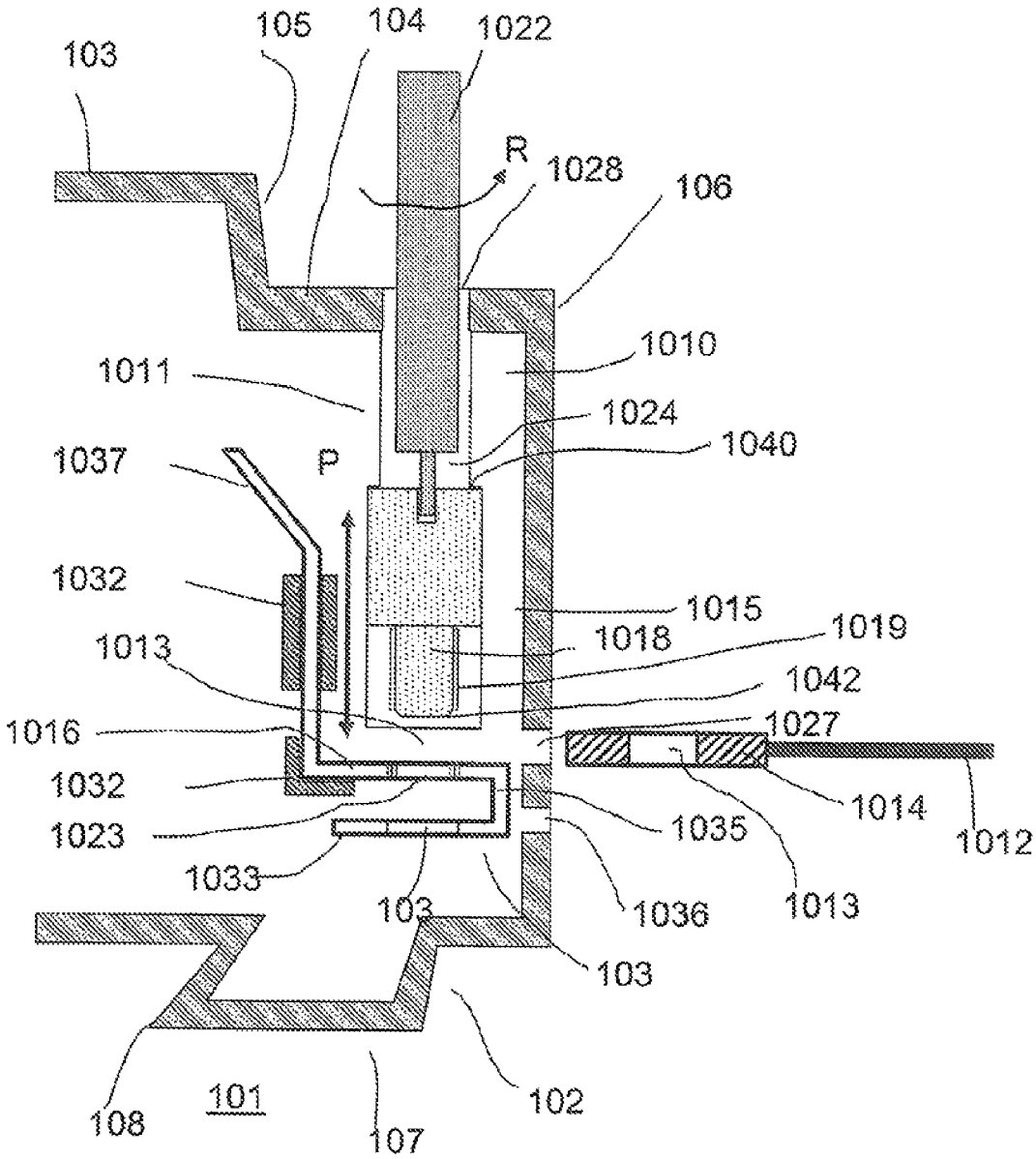
FIG. 4 shows a second embodiment of the present invention, in which the screw head of the terminal screw is not provided with a thread.

FIG. 4 shows a further embodiment of the present invention. All like components or modules or components or modules with like functions are denoted in FIG. 4 with the reference numerals as in FIGS. 1 to 3, preceded by "10".

In this embodiment there is no external thread on the screw head and no internal thread on the inner surface of the guide channel 1024. Displaceable coupling between the screw head and the guide channel 1024 is achieved by the fact that the casing surface of the cylindrical screw head slides along the casing surface of the guide channel 1024 which is also formed so as to be cylindrical. This reliably prevents tilting of the terminal screw 1015 in the guide channel 1024 and ensures that the axis of the terminal screw 1015 is always aligned with the axis of the screw hole 1023 in such a way that when the terminal screw 1015 is lowered in the guide channel 1024 from the open position into the set-down position, the shank 1018 slides reliably into a position in which it can become engaged by means of the internal thread in the screw hole 1023.

An undercut 1040 provided in the guide channel 1024 prevents the terminal screw 1015 from being lost. The undercut 1040 may be formed as an annular elevation or a narrowing of the diameter of the guide channel 1024 in the upward direction. The cross-sectional area, reduced by the undercut 1040, of the guide channel 1024 is still large enough to allow a screw driver 1022 to pass therethrough in order to actuate the terminal screw 1015, but is smaller than the cross-sectional area of the screw head so that said head is held captive to some extent in the guide channel 1024.

The terminal screw 1015 may in this case be raised from the set-down position to the open position, by, for example, the magnetic retentive force of the terminal screw 1025 to a magnetic screwdriver 1022.

In a further embodiment according to the present invention, the free end of the shank 1018 is slightly conically tapered, which is indicted by the bevel 1042. On the other hand, annular terminal shoes 1014 are generally very thin, and the depth of the ring of a terminal shoe 1014 of this type is often less than 1 mm. In some circumstances, it is therefore sufficient to press a thin terminal shoe 1014 of this type firmly against the free end of the shank 1018 in the set-down position in order to push the terminal screw 1015, via the bevel 1042, upwards far enough for the terminal shoe 1014 to slide into its connection position on the connection plate 1016. In this case, installation is further simplified since the terminal screw 1015 does not have to be raised separately manually and there is no need to bring it into a specific open position before being able to insert the terminal shoe 1014.

The undercut and the bevel are also present in the embodiment shown in FIG. 1 to 3 and are denoted with the reference numerals 40 and 42 respectively in said figures. However, the particular functional advantages thereof, such as holding the terminal screw "captive" and automatically pushing the terminal screw upwards when inserting the connecting conductor, play a lesser role in FIG. 1 to 3, since both functions are substantially covered by the internal thread on the inner side of the guide channel in cooperation with the external thread on the outer casing surface of the screw head.

List of reference numerals

| | |
|---|---|
| 1, 101 | Installation switch device |
| 2, 102 | Insulating material housing |
| 3, 103 | Leading front face |
| 4, 104 | Trailing front face |
| 5, 105 | Leading side face |
| 6, 106 | Trailing side face |
| 7, 107 | Fastening face |

-continued

| List of reference numerals | |
|---|---|
| 8, 108 | Fixed tab |
| 10, 1010 | Terminal socket |
| 11, 1011 | Connecting terminal arrangement |
| 12, 1012 | Connecting strip |
| 13, 1013 | Opening in the terminal shoe |
| 14, 1014 | Annular terminal shoe |
| 15, 1015 | Terminal screw |
| 16, 1016 | Connection plate |
| 17, | Screw head |
| 18, 1018 | Shank |
| 19, 1019 | External thread of the shank |
| 20 | End face of the screw head |
| 21 | Slot |
| 22, 1022 | Screwdriver |
| 23, 1023 | Screw hole in the connection plate |
| 24, 1024 | Guide channel in the terminal socket |
| 25 | Internal thread of the screw hole |
| 27, 1027 | Insertion opening |
| 28, 1028 | Access opening |
| 30, 1030 | Busbar |
| 32, 1032 | Web-like projections |
| 33, 1033 | Second leg |
| 34, 1034 | Opening in second leg |
| 35 | Web |
| 36, 1036 | Testing opening |
| 37, 1027 | Conductor rail |
| 38 | External thread of the screw head |
| 39 | Internal thread in the guide channel |
| 40, 1040 | Undercut |
| 42, 1042 | Bevels on the end of the shank |

What is claimed is:

1. An installation switch having an insulating housing and a terminal connecting arrangement for clamping a connecting conductor having an annular terminal shoe, the terminal connecting arrangement comprising:

a terminal socket having an interior disposed between an insertion opening for receiving the terminal shoe and an access opening, the interior including a guide channel with an inner surface;

a terminal screw, having a length which is less than the guide channel, comprising a screw head and a screw shank disposed in the interior of the terminal socket, the screw head having a guide surface that engages the inner surface of the guide channel such that the screw is actuatable in a longitudinal direction within the interior of the terminal socket between an open state and a clamped state;

a connection plate having a screw hole with interior threads for threadably engaging the terminal screw when in the clamped state; and a retaining device formed by a section of the guide channel having a reduced cross section that is smaller than a cross section of the screw head corresponding to the guide surface such that preventing the terminal screw is unable to pass through the reduced cross section and be removed from the terminal socket when in the open state, wherein the open state provides a gap allowing the terminal shoe to be inserted into the insertion opening, the clamped state provides the screw shank being engaged with the terminal shoe, and wherein access to the terminal screw is provided via the access opening of the terminal socket to allow for actuation of the terminal screw.

2. The installation switch as recited in claim 1, wherein the terminal shoe is clamped between the screw head and the connection plate in the clamped state.

3. The installation switch as recited in claim 1, wherein the screw head includes a cylinder extending longitudinally in the longitudinal direction of actuation of the screw.

4. The installation switch as recited in claim 1, wherein the inner surface of the guide channel includes internal threads and the guide surface of the screw head includes external threads, the internal threads configured for threaded engagement with the external threads of the screw head.

5. The installation switch as recited in claim 4, wherein the internal threads of the interior engage with the external threads of the screw head in the open state, displaceably holding the terminal screw in an open state.

6. The installation switch as recited in claim 5, wherein the internal threads of the interior is adjacent to the interior threads of the screw hole.

7. The installation switch as recited in claim 1, further comprising a U-shaped busbar having a first leg and a second leg connected via a web, the busbar disposed in the housing, and wherein the first leg includes the connection plate.

8. The installation switch as recited in claim 7, further comprising a conductor rail coupled to an end of the connection plate to provide a connection to additional conductors in the installation switch.

9. A terminal connecting arrangement for an installation switch having an insulating housing and a terminal connecting arrangement for clamping a connecting conductor having an annular terminal shoe, the terminal connecting arrangement comprising:

a terminal socket having an interior including internal threads disposed between an insertion opening for receiving the terminal shoe and an access opening;

a terminal screw having a screw head with external threads and a screw shank disposed in the interior of the terminal socket, the screw being actuatable in a longitudinal direction within the interior of the terminal socket between an open state and a clamped state;

a connection plate having a screw hole with interior threads for threadably engaging the terminal screw when in the clamped state;

a retaining device formed between the access opening and the internal threads and having a cross section through which the terminal screw is unable to pass; and wherein the internal threads are configured for threaded engagement with the external threads of the screw head, the open state provides a gap allowing the terminal shoe to be inserted into the insertion opening, the undercut of the retaining device prevents the terminal screw from being removed from the terminal socket when in the open state, the clamped state provides the screw shank being engaged with the terminal shoe, and wherein access to the terminal screw is provided via the access opening of the terminal socket to allow for actuation of the terminal screw.

10. The terminal connecting arrangement as recited in claim 9, wherein the internal threads of the interior engage with the external threads of the screw head in the open state, displaceably holding the terminal screw in an open state.

11. The terminal connecting arrangement as recited in claim 9, wherein the terminal shoe is clamped between the screw head and the connection plate in the clamped state.

12. The terminal connecting arrangement as recited in claim 9, wherein the internal threads of the interior is adjacent to the interior threads of the screw hole.

13. The terminal connecting arrangement as recited in claim 9, further comprising a U-shaped busbar having a first leg and a second leg connected via a web, the busbar disposed in the housing, and wherein the first leg includes the connection plate.

14. The terminal connecting arrangement as recited in claim 9, further comprising a conductor rail coupled to an end of the connection plate to provide a connection to additional conductors in the installation switch.

* * * * *